US006509392B1

(12) United States Patent
Jhaveri et al.

(10) Patent No.: US 6,509,392 B1
(45) Date of Patent: Jan. 21, 2003

(54) FOUNDRY BINDER AND PROCESS

(75) Inventors: Satish S. Jhaveri, Oakville (CA); Frank Mancina, Windsor (CA); Anita F. Aranha, Canton, MI (US); Calvin K. Johnson, Lockport, IL (US)

(73) Assignee: H.A. International LLC, Westmont, IL (US)

( * ) Notice: Subject to any disclaimer, the term of this patent is extended or adjusted under 35 U.S.C. 154(b) by 0 days.

(21) Appl. No.: 09/490,577

(22) Filed: Jan. 25, 2000

(51) Int. Cl.[7] ..... B22C 1/22
(52) U.S. Cl. ..... 523/142; 523/139; 523/147
(58) Field of Search ..... 523/142, 143, 523/145, 146, 147

(56) References Cited

U.S. PATENT DOCUMENTS

| | | | | |
|---|---|---|---|---|
| 4,101,465 | A | | 7/1978 | Lockwood et al. |
| 4,273,700 | A | | 6/1981 | Kho |
| 4,305,991 | A | | 12/1981 | Meyborg et al. |
| 4,390,644 | A | | 6/1983 | Clarke et al. |
| 4,448,907 | A | | 5/1984 | Schafer |
| 4,851,457 | A | | 7/1989 | Kurple |
| 5,084,485 | A | | 1/1992 | Heilig et al. |
| 5,098,936 | A | | 3/1992 | Choi et al. |
| 5,102,918 | A | | 4/1992 | Moriya |
| 5,132,339 | A | * | 7/1992 | Carpenter et al. ..... 523/143 |
| 5,157,074 | A | | 10/1992 | Metzger et al. |
| 5,162,385 | A | | 11/1992 | Hartwig et al. |
| 5,175,228 | A | | 12/1992 | Wang et al. |
| 5,286,765 | A | | 2/1994 | Franke et al. |
| 5,382,626 | A | | 1/1995 | Credali et al. |
| 5,455,287 | A | | 10/1995 | Carpenter et al. |
| 5,473,009 | A | | 12/1995 | Kimura et al. |
| 5,618,904 | A | | 4/1997 | Martin et al. |
| 5,648,421 | A | | 7/1997 | Thiele et al. |
| 5,688,857 | A | | 11/1997 | Chen et al. |
| 5,698,613 | A | | 12/1997 | Jhaveri |
| 5,786,409 | A | | 7/1998 | Kurple |
| 5,792,802 | A | | 8/1998 | Geoffrey |
| 5,852,071 | A | | 12/1998 | Geoffrey |
| 5,859,091 | A | | 1/1999 | Chen et al. |
| 5,908,894 | A | | 6/1999 | Genz et al. |

* cited by examiner

*Primary Examiner*—Edward J. Cain
*Assistant Examiner*—Katarzyna Wyrozebski Lee
(74) *Attorney, Agent, or Firm*—Donald E. Egan

(57) ABSTRACT

No-bake foundry binders that produce foundry shapes with improved hot strength are provided. The binder comprises a polyether polyol component, a polyisocyanate component and a catalyst component that promotes the trimerization of polyisocyanates to polyisocyanurates. Supplemental catalysts that promote the reaction of the isocyanate with the polyols may also be used. Foundry mixes are prepared by mixing the binder with a foundry aggregate and making foundry shapes using the no-bake process.

22 Claims, No Drawings

FOUNDRY BINDER AND PROCESS

FIELD OF INVENTION

This invention relates to no-bake foundry binders that produce foundry shapes with improved hot strength. The binder comprises a polyol component that contains at least one polyether polyol, a polyisocyanate component and a catalyst component that contains a catalyst that promotes the trimerization of polyisocyanates to form polyisocyanurates. The catalyst component may also include supplemental catalysts that promote the reaction of the isocyanate with the polyols. Foundry mixes are prepared by mixing the binder with a foundry aggregate at ambient temperature. Foundry shapes, including cores and molds, having improved hot strength are prepared by shaping the mix and setting the binder using the no-bake process.

BACKGROUND OF THE INVENTION

One of the major methods used by the foundry industry to produce metal castings is sand casting. In this process, sand or other aggregates are bonded together to give shaped cores or molds using organic or inorganic binders. Molten metal is then poured into the bonded sand mold and allowed to cool producing metal castings having the shape of the sand mold.

Many kinds of binders have been used to make foundry cores and molds. They include hot box binders, cold box binders, shell process binders, no-bake binders, clay binders, and baking binders such as core oil. The binders strengthen the molds and cores.

A major process used in the foundry industry is the no-bake process. In this process, a binder system that will cure at ambient temperature is mixed with a foundry sand or other aggregate and allowed to cure at room temperature to produce resin bonded molds and cores. Generally a catalyst is added to control the cure speed of the binder system. Sufficient work time is needed to allow the binder system to be mixed with the sand and the foundry core or mold patterns to be filled and compacted before the binder hardens. Varying the catalyst type and quantity is a convenient way to adjust the cure speed of the different no-bake binder systems used in foundries.

One type of no-bake binder that has been used for casting non-ferrous metals such as aluminum, magnesium and lightweight metals is amine-based polyol urethane binders. They are used in these applications because of the quick breakdown and excellent shakeout at relatively low metal casting temperatures. U.S. Pat. Nos. 4,448,907 and 4,273,700 are examples of the prior art.

Another example is polyether polyol urethane systems cured with liquid tertiaryamine catalysts. U.S. Pat. Nos. 5,455,287 and 5,859,091 are examples of this prior art.

One of the limitations of the amine polyol based binder systems or the amine catalyzed polyol systems is their low hot strength and easy shakeout. In some non-ferrous and ferrous casting applications, they breakdown too rapidly causing erosion of the sand molds and cores and other metal casting defects. Sometimes, these problems can be reduced or eliminated by applying a refractory coating to the surface of amine polyol urethane bonded cores and molds. Even where this works, it adds cost and process time to the metal casting process.

Foundry binders based on urethanes produced from polyester-based polyol have been described in the prior art, e.g. U.S. Pat. No. 5,698,613. The polyester-based polyol systems do not have increased hot strength and those systems that are based on aromatic polyester-based polyols tend to produce an untoward level of smoke in use.

Therefore, there is a need for a binder system that maintains the good characteristics of amine polyol such as very low odor, low volatile organic chemical emissions, no free formaldehyde, and no free phenol while providing increased hot strength and resistance to mold erosion during the casting process.

SUMMARY OF THE INVENTION

It is an objective of this invention to provide a foundry binder composition that can be used to produce foundry shapes with improved hot strength. The binder comprises a polyol component that contains at least one polyether polyol, a polyisocyanate component and a catalyst component that contains a catalyst that promotes the trimerization of polyisocyanates to form polyisocyanurates. The catalyst component may also include supplemental catalysts that promote the reaction of the isocyanate with the polyols. The foundry molds and cores made with binders that develop polyisocyanurate structures have improved hot strength. The foundry molds and cores made with binders that develop polyisocyanurate/polyurethane structures cure quickly and have improved hot strength. The increased hot strength reduces casting defects such as mold and core erosion.

It is a further objective of this invention to provide a foundry binder that allows the hot strength to be varied to meet different casting requirements by using trimerization catalysts in combination with tertiary amine catalysts. The ratios can be varied to adjust cure speed and hot strength of the binder system.

Another objective of the invention is to provide binders that do not contain any free formaldehyde or phenols and preferably do not contain any unreactive solvents. The systems are essentially odorless. When reactive solvents or no solvents are used, there are no volatile organic compounds (VOC's) present in the binder system. Thus, the compositions of this invention are environmentally attractive.

A further objective of this invention is to provide foundry cores and molds with improved hot strength when used to make metal castings. The higher hot strength cores and molds show greater resistance to casting defects such as erosion and burn in during the casting process. The use of refractory coatings to protect the cores and molds from erosion during the casting process with non-ferrous metals may be reduced or eliminated. The cost of any needed coatings and the process time to apply the coatings may be reduced or eliminated.

BEST MODE AND OTHER MODES OF PRACTICING THE INVENTION

The binder of the present invention comprises a polyol component that contains at least one polyether polyol, a polyisocyanate component and a catalyst component that contains a catalyst that promotes the trimerization of polyisocyanates to form polyisocyanurates. The catalyst component may also include supplemental catalysts that promote the reaction of the isocyanate with the polyols.

The foundry binders of the present invention may be used as either two or three part systems. In a three-part system, the three parts are a polyol component (sometimes referred to as "Part I"), a polyisocyanate component (sometimes referred to as "Part II") and a catalyst component (sometimes referred to as "Part III"). In a two-part system, the catalyst component is incorporated into the polyol component to create Part I, while the polyisocyanate component functions as Part II. Alternatively, some of the catalyst can be incorporated into the polyol component to form Part I and the remainder of the catalyst component is used as a Part III. A three component system is preferred because it allows the cure speed to be adjusted as required to meet foundry productivity needs.

The Polyol Component

The polyol component of he present invention must include at least one polyether polyol. Suitable polyether polyols are produced by reacting an alkylene oxide with polyols such as ethylene glycol, diethylene glycol, propylene glycol, trimethylol propane, pentaerythritol, sorbitol, hydroxyquinone di(βhydroxyethyl) ether, and sucrose. The alkylene oxides used to prepare the polyether polyols include ethylene oxide, propylene oxide, butylene oxide, styrene oxide and mixtures thereof. The polyols useful in this invention have a functionality of two (2) or greater. The polyether polyols may have primary and/or secondary hydroxyl groups. The preferred polyether polyols of this invention have a hydroxyl functionality from about 2 to about 8. Diols may be used and still achieve sufficient crosslinking to produce strong cores and molds because isocyanurates formed by the trimerization of the isocyanates causes significant crosslinking to occur. However, it is generally preferred that the polyol component be mixtures of at least one diol and at least one polyol having a functionality of 3 to 7.

In some cases it is desirable to add some low viscosity polyols such as ethylene glycol and diethylene glycol to the higher molecular weight polyether polyols to reduce their viscosity. The polyol Part I component preferably has a viscosity of less than 1000 cps and most preferably a viscosity of less than 500 cps.

Examples of specific aliphatic polyether polyols useful in this invention are listed below:

Pluracol P-410R, a polypropylene glycol formed by adding propylene oxide to propylene glycol available commercially from BASF Corporation. This difunctional polyol has a hydroxyl number of 250–270 mg KOH/g, a molecular weight of 400, and a viscosity of 73 cps at 77° F.

Pluracol P-710, a polypropylene glycol formed by adding propylene oxide to propylene glycol and available commercially form BASF Corporation. This difunctional polyol has a hydroxyl number of 140–150 mg KOH/g a molecular weight of 700 and a viscosity of 139 cps at 77° F. (25° C.).

Pluracol P-2010, a polypropylene glycol formed by adding propylene oxide to propylene glycol and available commercially from BASF Corporation. This difunctional polyol has a hydroxyl number of 53.4–58.6 mg KOH/g, a molecular weight of 2000 and a viscosity of 250 cps at 77° F. (25° C.).

Voranol 230–112, a polyether triol polyol commercially available from Dow Chemical Company. It has a hydroxyl number of 106–118 mg KOH/g a molecular weight of 1500 and a viscosity of 300 cP at 77° F.

Voranol 280, a sucrose/glycerin initiated polyether polyol available commercially from Dow Chemical Company. It has a hydroxyl number of 280 mg KOH/g, a functionality of seven, and a viscosity of 3311 cks at 77° F. (25° C.).

Although not preferred, small amounts of amine based polyols can be added to the polyether polyols. Amine based polyols tend to promote the reaction between isocyanates and polyols. If too much amine-based polyol is added, the amine-based polyol may catalyze sufficient urethane bond formation to reduce the hot strength of the cured binder. The trimerization catalyst must provide enough isocyanurate formation to increase hot strength compared to conventional urethane systems. Minor amounts of phenolic resins may also be added to the Part I polyol system.

An example of an amine based polyol that could be added in small amounts to the polyols useful in this invention is Voranol SF-265, a commercial aliphatic amine polyol available form Dow Chemical Company. It has a hydroxyl number of 625–645 mg KOH/g, a functionality of three and a viscosity of 430 cps at 25° C. The amount of amino polyol that may be added to the polyols of this invention is generally less than 5% by weight of the Part I component.

Minor amounts of aliphatic polyester polyols may be included in the polyol component. Examples of aliphatic polyester polyols are polyethylene adipate diol and polycaprolactone diol. Aromatic polyester polyols are undesirable because of the increased odor and smoke generated when metal is poured into molds containing aromatic polyester structures.

Small amounts of solvents may be added to polyol component to reduce the viscosity and make it easier to pump and mix the polyol component with the sand. A wide variety of different solvents could be used including esters, carbonates, ketones and alcohols. Preferred solvents are those that contain at least one alcohol group that are isocyanate reactive to become incorporated into the cured binder system, which reduces the emission of volatile organic compounds from the system. Examples of useful isocyanate reactive solvents include methanol, propanol, furfuryl alcohol, ethanol, butanol, diethylene glycol mono methyl ether, diethylene glycol monoacetate, 2,2,4-trimethyl-1,3-pentanediol monoisobutyrate. The amount of solvents added to the polyol component is usually less than 30% by weight of the polyol component and preferably less than 15 weight percent.

The Polyisocyanate Component

Organic polyisocyanates useful in this invention are liquid polyisocyanates with a functionality of two or more and preferably a functionality from 2 to 6. They may be aliphatic, cycloaliphatic, aromatic polyisocyanates or mixtures of these. The polyisocyanate Part II compound should have a viscosity at 25° C. of less than 1000 cps and preferably less than 500 cps.

Examples of useful isocyanates include hexamethylene diisocyanate, 4,4' dicyclohexylmethane diisocyanate, 2,4-toluene diisocyanate, 2,6-toluene diisocyanate, 4,4' methylene bisphenyl isocyanate, polymethylene polyphenyl isocyanates, 1,5-naphthalene diisocyanate and triphenyl methane triisocyanate. Other examples are isocyanate capped polyether urethane prepolymers made by reacting an excess of 2,4-toluene diisocyanate and 2,6-toluene disocyanate with polyether polyols. The preferred isocyanate is polymethylene polyphenyl isocyanate.

An example of a useful polymethylene polyphenyl isocyanate is PAPI 1027 available commercially from Dow Chemical Company. It has a isocyanate equivalent weight of 134, a functionality of 2.7, a viscosity of 150–220 cps at 25° C. and an average molecular weight of 340.

Solvents may be added to the polyisocyanates to reduce their viscosity or to dissolve solid polyisocyanates. Useful solvents must be unreactive with the isocyanates at room temperature. Examples of useful Part II solvents include esters, ketones, ethers and hydrocarbons. The amount of solvent used in the Part II component should be less than 30% by weight and preferably less than 10%. Most preferably polymethylene polyphenyl isocyanates are used without any solvent.

Stoichiometry

It is essential that the binder include an excess of isocyanate groups in relation to the hydroxyl groups of the polyols in order to allow at least a portion of the isocyanate groups to be trimerized to form isocyanurates. The reaction of the polyol hydroxyl groups to form urethane bonds competes with the trimerization of the isocyanate groups. As is explained above, the foundry binders of the present invention produce foundry cores and molds having improved hot strength, that is achieved by the formation of polyisocyanurates when the binder is cured. The curing speed of the binder of the present invention can be increase by the use of a supplemental catalyst that promotes the reaction between the isocyanate groups and the hydroxyl groups. However, the addition of the supplemental catalyst further competes with the trimerization catalyst for the isocyanate groups. To form significant amounts polyisocyanurate, the ratio of isocyanate groups to hydroxyl groups must be significantly greater than 1 to 1. The ratio of isocyanate groups to hydroxyl groups in the binders must be at least 1.5 to 1 and preferably will be greater than 2.0 to 1. It is most preferred to have ratio of isocyanate groups to hydroxyl groups in the range of from about 3:1 to about 10:1. In the Examples set forth below, the binders that illustrate the present invention have a ratio of isocyanate groups to hydroxyl groups in the range of 3.2 to 5.0.

The Catalyst Component

The foundry binders of the present invention must include a catalyst that promotes the isocyanate trimerization to form isocyanurate. Moreover, the catalyst must promote the formation of sufficient isocyanurate to raise the hot strength of the cores and molds made with the cured binder, compared to hot strength of the cores and molds made a conventional urethane binders. In the binder systems of the present invention, some of the isocyanate groups react with the polyols to form urethane bonds, but a significant portion of the isocyanate groups are trimerized to form isocyanurates. It is essential that significant trimerization occurs at ambient temperatures to raise the hot strength of the cured mold or core made with the binder of the present invention, compared to the hot strength of the cured mold or core made conventional polyol urethane binder.

The preferred catalysts are potassium acetate, potassium 2-ethylhexanoate and diazobicycloundecene octoate. Other useful isocyanate trimerization catalysts include alkali metal salts of aliphatic carboxylic acids, phenates or alcoholates, ammonium salts of organic carboxylic acids, carboxylic acid salts of tertiary amines, sulfonium zwitterions, quarternary ammonium carboxylates, compounds such as 2,4,6tris (dimethylaminomethyl) phenol and tris (dialkylaminoalkyl)-s-hexahydrotriazine and organic phosphines. U.S. Pat. No. 5,175,228 contains an extensive listing of catalysts that are known to trimerize isocyanates to isocyanurates. Any of these known classes of trimerization catalyst compounds may be used, provided they trimerize isocyanates of this invention at ambient temperature. Mixtures of trimerization catalysts may be used. For example, potassium acetate may be used in combination with potassium 2-ethylhexanoate and/or diazobicycloundecene octoate.

The amount of trimerization catalyst used can vary widely depending upon the cure speed required by the foundry, sand temperature and the type of catalyst selected. Generally the amount of catalyst can vary from about 0.1% to about 10% by weight and preferably from about 0.3% to about 6% by weight based on the total weight of binder.

Supplemental catalysts that promote the reaction between isocyanates and polyols may be used in combination with the trimerization catalyst to adjust the cure speed and the relative hot strength of the cured binder. The supplemental urethane catalyst may be incorporated into the polyol Part I component or can be used in a Part III catalyst component. Examples of useful supplemental urethane catalysts include various tin, mercury, lead, bismuth and tertiary amine catalysts known to the art. Examples include dibutyltin dilaurate, dibutyltin diacetate, phenyl mercuric acetate, mercuric naphthenate, lead naphthenate, benzyldimethylamine, triethylenediamine, triethylamine, and tetramethylbutanediamine. The amount of supplemental catalyst used varies widely depending on the cure speed required, the sand temperature and the type of catalyst selected for use. Generally from about 0.03% to about 5.0% (based on the weight of the binder) of the supplemental urethane catalyst may be used.

The catalyst or catalysts may be dissolved in solvents to lower their viscosity and increase their volume. Larger amounts of catalyst are easier to weigh and/or meter into foundry sand mold compositions. Examples of useful solvents are dipropylene glycol, ethylene glycol, diethylene glycol, 2,2,4-trimethyl-1,3-pentanediol monoisobutyrate, propylene carbonate, diethylene glycol monomethyl ether, dibasic ester, diacetone alcohol and the like. The amount of solvent used with the catalyst or catalysts may range from 0% up to about 95% based on the weight of the catalyst.

The amount of catalyst or catalysts used in preparing the cured foundry shapes varies widely. Generally sufficient catalysts are added to the binder composition to give hard molds and/or cores that can be stripped from the foundry patterns from about two (2) minutes to about 20 minutes and preferably from about 4 minutes to about 12 minutes after placing the sand and binder composition into foundry mold patterns.

When used, the supplemental urethane catalyst may be combined with the trimerization catalyst in the Part III catalyst component or in the Part I polyol component. Alternatively, the optional urethane catalyst may be incorporated into the Part I polyol component and the trimerization catalyst used in the Part III component. Another option is to incorporate the trimerization catalyst into the polyol Part I component and use the supplemental urethane catalyst in the Part III component.

The Foundry Process

Foundry shapes, including both foundry cores and molds, are made by mixing the binder compositions of the present invention with aggregates using mixing methods well known in the art. One common method is to meter the Part I, Part II and any Part III components into a foundry aggregate such as silica sand as it goes through a high speed continuous mixer to form a foundry mix. The foundry mix, i.e. the intimately mixed sand binder composition, is placed in a pattern and allowed to cure at ambient temperature. After curing, the self-supporting foundry shape can be removed from the pattern. The foundry shapes, typically including mold halves and any needed cores, are assembled to give a complete mold into which molten metal can be poured. On cooling, a metal casting having the shape of the sand mold is produced. Suitable aggregate materials for foundry shapes include silica sand, lake sand, zircon, olivine, chromite, mullite and the like.

The amount of binder used to make foundry shapes is generally less than 10% and preferably from about 0.5% to 8.0% and most preferably from about 0.6% to about 5.0% based on the weight of the aggregate.

Additives commonly used in the foundry art to improve casting quality such as black iron oxide, red iron oxide, clay, wood flour and the like may be incorporated into the foundry mix compositions. Other optional ingredients that may be added to the polyol component are adhesion promoters and release agents. Silane coupling agents such as gamma-ureidopropyltriethoxysilane, and gamma-aminopropyltrimethoxysilane may be added to increase tensile strengths and improve humidity resistance. Release agents such as glycerol trioleate and oleic acid may be added in small amounts to improve release from mold patterns. Although not preferred, core and mold coatings may be applied to the bonded sand cores and molds of this invention to reduce erosion and improve casting finish in difficult casting applications.

The following examples will serve to illustrate the preparation of several foundry binder compositions within the scope of the present invention. It is understood that these examples are set forth for illustrative purposes and that many other compositions are within the scope of the present invention. Those skilled in the art will recognize that similar foundry binder compositions may be prepared containing different quantities of materials and equivalent species of materials than those illustrated below. All parts are by weight unless otherwise specified.

EXAMPLE I

A polyol component for a no-bake foundry binder in accordance with the present invention was prepared by blending together 71.8 parts of Voranol 230-112, a polyether triol having a viscosity of 300 cps available from Dow Chemical Company, 18.96 parts of Pluracol 410 R, a polyether diol having a viscosity of 77 cps available from BASF Corporation, 4.79 parts of Texanol, a 2,2,4-trimethyl-1,3-pentanediol monoisobutrate available from Eastman Chemical Company, 0.2 parts of A-1160, a silane available from Witco Corporation and 4.25 parts of Polycat 46, a 38% solution of Potassium acetate in ethylene glycol available commercially from Air Products and Chemicals, in a bottle at room temperature. This polyether polyol component had a viscosity of 282 cps at 25° C. and a specific gravity of 1.083@ 60° F. It was used to make the "Example I" binder.

A control polyether polyol component for a no-bake foundry binder was prepared by blending together 75 parts of Voranol 230-112 polyether triol, 10 parts of Thanol SF265 aliphatic amine polyether polyol having viscosity of 430 cps and available from Eastman Chemical Company, 9.8 parts of Pluracol 410 R polyether and 5.0 parts of Texanol, 2,2,4-trimethyl-1,3 pentanediol monoisobutyrate available from and Eastman Chemical Company and 0.2 parts of A-1160 silane in a plastic bottle at room temperature. The control polyether polyol component had a viscosity of 270 cps at room temperature.

The binder performance of the control polyol was compared to the Example I polyol which contains Polycat 46 trimerization catalyst. To prepare the Example I binder 3000 g of Fairwater 5574 silica sand was added to a Hobart mixer. Then 18 g of the Example I polyol was added and mixed for two (2) minutes. Next 27 g of PAPI 1027 polymethylene polyphenylisocyanate available from Dow Chemical Company was added and mixing continued for one (1) minute. To prepare the Control binder 3000 g of Fairwater 5574 silica sand was added to a Hobart mixer. Then 18 g of the Control polyol and 0.18 g of the catalyst component (1% based on the weight of the polyol component) was added and mixed for two (2) minutes. Next 27 g of PAPI 1027 polymethylene polyphenylisocyanate available from Dow Chemical Company was added and mixing continued for one (1) minute. The binders had a NCO/OH ratio of approximately 3.5 for the Example I binder and 3.7 for the Control binder.

The coated sand was immediately discharged and placed in a Dietert 12 gang core-box to form standard American Foundrymen's Society one (1) inch tensile briquettes. The briquettes were allowed to cure at room temperature for ½ hour, 2 hours and overnight.

The tensile strengths of the briquettes were measured using a Simpson/Gerosa Electronic Universal sand strength machine, Model No. 42104. The relative hot strengths of the control and Example I containing a trimerization catalyst were compared by completely wrapping the cores in aluminum foil and placing them in an oven at 600° F. Samples were removed from the oven at 3, 6, 9 and 12 minutes and the tensile strengths of the hot cores immediately measured.

The data is summarized in Table 1.

TABLE 1

| | Control | Example I |
|---|---|---|
| Part I | Amine Polyol Component | Polyol Component w/ K Acetate Catalyst |
| Part II | PAPI 1027 | PAPI 1027 |
| Part III | 1% Amine Cat.* | Premixed with polyol component |
| Tensile Strength psi | | |
| ½hour | 189 | 172 |
| 2 hour | 511 | 507 |
| Overnight | 426 | 352 |
| Hot Strength psi | | |
| 3 minutes | 164 | 147 |
| 6 minutes | 163 | 151 |
| 9 minutes | 110 | 144 |
| 12 minutes | 87 | 113 |

The controlbinder contained 1% (based on the weight of Part I) of a catalyst composition containing 19.8% 1,4-Diazobicyclo<2,2,2>octane, 40.2% dipropylene glycol and 40% Texanol available from Eastman Chemical Company.

The Example I binder contains only potassium acetate as the catalyst while the control binder contains an amine polyether polyol that functions as a catalyst as well as 1% of a Part III amine catalyst. The data summarized in Table 1 shows that the control binder and the Example I binder develop comparable tensile strengths at room temperature. However, the binder of the present invention develops better strength at 600° F. as shown by the higher hot strength values.

EXAMPLE II

This example demonstrates the use of a small amount of supplemental urethane catalyst solution to adjust cure speed while maintaining the high hot strength obtained with potassium acetate trimerization catalyst in the binder system.

A polyether polyol component in accordance with the present invention was prepared by blending 71.25 parts of Voranol 230-112 polyether triol, 18.81 parts of Plurocol 410R polyether tetrol, 4.75 parts of Texanol, 0.19 parts of A-1160 silane and 5 parts of a 38% solution of potassium acetate in ethylene glycol.

Foundry mixes were prepared as described in Example I using a Hobart mixer. In case A, no supplemental urethane catalyst solution is used. In case B, 1% based on Part I weight of an supplemental urethane catalyst solution was added to speed the cure. The supplemental urethane catalyst solution was composed of 19.8% 1,4-Diazobicyclo<2,2,2>octane, 40.2% dipropylene glycol and 40% Texanol. The comparative properties are shown in Table 2. The binders had a NCO/OH ratio of approximately 3.4.

TABLE 2

| | Case A | Case B |
|---|---|---|
| Part I | Example II polyol component | Example II polyol component |
| Part II | PAPI 1027 | PAPI 1027 |
| Part III | None | 1% supplemental urethane Catalyst |
| Strip time, minutes | 12.3 | 7.2 |
| Tensile strength psi | | |
| ½hour | 261 | 347 |
| 2 hours | 416 | 396 |
| Overnight | 327 | 271 |
| Hot strength @ 600° F. | | |
| 3 minutes | 126 | 150 |
| 6 minutes | 123 | 148 |
| 9 minutes | 106 | 114 |
| 12 minutes | 89 | 93 |

The strip time was determined by placing the coated sand in a round mold that is 7 inches in diameter and striking off any excess sand to give a smooth mold surface. Surface hardness was measured with a Dietert Green Hardness "B" Scale tester. A hardness of 75–80 is defined as the strip time.

The reduction in strip time from 12.3 minutes to 7.2 demonstrates the use of 1% of a supplemental catalyst can adjust the cure speed of the binder system. The hot strength values in Case A and Case B after nine (9) minutes and 12 minutes at 600° F. are similar showing that the high hot strengths from the potassium acetate catalyst are maintained when small amounts of supplemental urethane catalyst are added to adjust the cure speed.

EXAMPLE III

This example demonstrates that the binders of the present invention produce foundry shapes that have improved resistance to erosion by liquid metal during the process of filling a sand mold with molten metal. Therefore, American Foundrymen's Society erosion test molds were prepared. The erosion wedges were made with different urethane polyol binder systems. One half of the erosion wedge surface was coated with Delta-HA 03-375 coating to evaluate the effect of coating on erosion.

Erosion test wedges were prepared using a binder in accordance with the present invention and using two commercially available urethane polyol binder systems available from Delta-HA. The binders are described below.

A no-bake foundry binder in accordance with the present invention (Example 3 Binder) was prepared. The polyol component was made by blending 71.8 parts of Voranol 230-112, 18.96 parts of Pluracol 410R, 4.79 parts Texanol, 0.20 parts of A-1160 silane and 4.25 parts of a 38% solution of potassium acetate in ethylene glycol. The polyisocyanate component was PAPI 1027 polymeric isocyanate. The catalyst component was a solution of 3.3% 1.4-diazobicyclo<2,2,2>octane, 6.7% dipropylene glycol and 90% 2,2,4-trimethyl-1,3-pentanediol diisobutyrate.

Commercial Binder 1 was Delta-HA 20-215 Amine polyol Part I; Delta-HA 23-227 Polymeric isocyanate Part II and Delta-HA 17-960 Amine catalyst Part III.

Commercial Binder 2 was Delta-HA 20-215 Amine polyol Part I; Delta-HA 20-227 Polymeric isocyanate Part II; and Delta-HA 170-960 Amine Catalyst Part III.

Three foundry mixes were prepared by mixing sand with 1.5% by weight of the three binders in a Hobart mixer as described in Example I. The ratio of the polyol component to the polyurethane component for each binder is shown in Table 3. The binders had a NCO/OH ratio of approximately 3.5 for the Example III binder, 3.66 for Commercial binder 1 and 2.44 for Commercial Binder 2. All 3 binders included 1% of the catalyst, based on the weight of the polyol component. The Erosion wedge cores were immediately made and allowed to cure. One half of the wedge surface was coated with Delta-HA 03-375 coating and the other half was left uncoated.

Erosion tests were conducted several days after preparation of the erosion wedge cores and molds. Molten 356 aluminum was poured at 1325° F. onto the face of the erosion wedges. The castings were removed from the sand molds 20 minutes after pouring. The cold castings were examined for erosion. All of the coated wedge surfaces were free of erosion. The two commercially available urethane polyether amine polyol systems showed substantial erosion of the uncoated surface area. In contrast, the uncoated surface of wedges produced from the Example 3 binder, which contained the trimerization catalyst, showed no erosion.

TABLE 3

| Binder | Part I/Part II Ratio | Erosion, Coated Area | Erosion, Uncoated Area |
|---|---|---|---|
| Example 3 | 40/60 | None | None |
| Commercial 1 | 40/60 | None | Extensive |
| Commercial 2 | 50/50 | None | Extensive |

These tests clearly demonstrate the improved hot strength and improved metal casting results with the binder of the present invention. Surprisingly, the casting was as good as the coated surface area. Thus, the extra time and expense of coating the cores and molds may be eliminated with the product of this invention.

Example IV

This example demonstrates the use of tertiary amine salt catalyst to increase the hot strength of a polyol urethane binder system.

A polyether polyol component was prepared by blending 70.0 parts of Voranol 230-112 polyether polyol, 19.8 parts of Pluracol 410R polyol, 10.0 parts of diazobicycloundecene octoate and 0.2 parts of A-1160 silane in a plastic bottle.

The binder performance of the polyether polyol component containing diazobicycloundecene octoate trimerization catalyst was compared to the control binder described in Example 1 that contained an aliphatic amine polyether in the polyol component. Both binders used a 40/60 ratio of the polyol component to the iscyanate component. The binders had a NCO/OH ratio of approximately 4.8. Foundry mixes were prepared by mixing 1.5% of binder with sand in the Hobart mixer as disclosed in Example I.

These two binders were compared. The comparative tensile strengths and hot strengths were evaluated as described in Example I and are summarized in Table 4.

TABLE 4

| | Control | Example IV |
|---|---|---|
| Polyol component | Amine Polyol of Example 1 | Example 4 Polyol Containing Amine Salt Catalyst |
| Isocyanate component | PAPI 1027 | PAPI 1027 |
| Catalyst component | 1% Amine Catalyst | 1% Amine Catalyst |
| Tensile Strength, psi | | |
| ½hour | 118 | 198 |
| 2 hour | 487 | 473 |
| Overnight | 506 | 566 |
| Hot Strength, psi | | |
| 3 minutes | 188 | 231 |
| 6 minutes | 112 | 244 |
| 9 minutes | 60 | 173 |
| 12 minutes | 56 | 106 |

The data demonstrates that the use of the tertiaryamine salt, trimerization catalyst in the binder of the present invention greatly increases the hot strength of the foundry shapes

EXAMPLE V

This example demonstrates that the trimerization catalyst may be incorporated into the Part I polyol or added separately as a Part III. The polyol component containing the polyether polyol described in Example I, which contains a potassium acetate trimerization catalyst, was compared to the polyol component of Example V that does not contain any catalyst. In the latter case the potassium catalyst is used separately as Part III.

A polyol component of Example V was prepared by blending 71.8 parts of Voranol 230-112, 18.96 parts of Pluracol 410R, 9.04 parts of Texanol and 0.2 parts of A-1160 silane. This polyol component had a viscosity of 170 cps at 25° C.

A catalyst of Example V was prepared by blending together 0.66 parts of 1,4 diazobicyclo<2,2,2>octane, 1.34 parts of dipropylene glycol, 85 parts of Polycat 46 and 13 parts of Texanol.

Sand was coated in a Hobart mixer and tested for tensile strengths and hot strengths as described in Table V. 1.5% binder, 40/60 ratio Part I/Part II was used.

The binders had a NCO/OH ratio of approximately 3.5. The % catalyst is based on the weight of Part I.

TABLE 5

| | Catalyst in Polyol | Catalyst in Part III |
|---|---|---|
| Part I | Polyol of Example 1 | Polyol of Example V |
| Part II | PAPI 1027 | PAPI 1027 |
| Part III | 1% Amine Catalyst | 5% Catalyst of Example V |

TABLE 5-continued

| | Catalyst in Polyol | Catalyst in Part III |
|---|---|---|
| | of Example 1 | |
| Tensile Strength, psi | | |
| ½hour | 96 | 108 |
| 2 hour | 367 | 368 |
| Overnight | 479 | 401 |
| Hot Strength, psi | | |
| 3 minutes | 110 | 122 |
| 6 minutes | 107 | 88 |
| 9 minutes | 91 | 98 |
| 12 minutes | 125 | 109 |

EXAMPLE VI

This example demonstrates the use of potassium 2-ethylhexanoate catalyst to increase the hot strength of a polyol urethane binder system.

A polyether polyol component was prepared by blending 71.8 parts of Voranol 230-112 polyether polyol, 18.96 parts of Pluracol 410R polyol 4.79 parts of Texanol, and 0.2 parts of A-1160 silane in a plastic bottle. In order to form Part I, 4.25 parts of Potassium HEX-CEM 997 catalyst available commercially from OMG Americas, Inc. was added to the bottle. Potassium HEX-CHEM 977 is a mixture of 25% diethylene glycol and 75% potassium 2-ethylhexanoate.

The binder performance of this polyol component containing potassium 2-ethylhexanoate trimerization catalyst was compared to the polyol component of Example I that contained potassium acetate trimerization catalyst. The isocyanate component used as Part II is PAPI 1027 and Part III was an amine catalyst solution of 3.3% 1,4-diazobicyclo<2,2,2>octane, 6.7% dipropylene glycol and 90% Texanol. Coated sand was prepared using the Hobart mixer as disclosed in Example I. These two systems were compared.

A total of 1.5% binder based on sand weight was used. The Part I/Part II ratio was 40/60. This provided a NCO/OH ratio of 4.45 for Example VI and 3.5 in the control.

The results are summarized in Table VI.

TABLE 6

| | Control | Example V |
|---|---|---|
| Part I | Example 1 Polyol | Example VI Polyol |
| Part II | PAPI 1025 | PAPI 1027 |
| Part III | 1% Amine Catalyst of Example VI | 1% Amine Catalyst of Example VI |
| Tensile Strength, psi | | |
| ½hour | 89 | 60 |
| 2 hour | 311 | 384 |
| Overnight | 370 | 459 |
| Hot Strength, psi | | |
| 3 minutes | 81 | 68 |
| 6 minutes | 73 | 95 |
| 9 minutes | 96 | 140 |
| 12 minutes | 97 | 108 |

The performance differences may be attributable to the use of different catalysts or to differences in the NCO/OH ratios in the two binder compositions.

The forms of invention shown and described herein are to be considered only as illustrative. It will be apparent to those skilled in the art that numerous modifications may be made therein without departing from the spirit of the invention and the scope of the appended claims.

We claim:

1. A no-bake foundry mix for producing foundry shapes comprising:

a major amount of a foundry aggregate and a minor amount of binder, said binder comprising:

(a) a polyol component comprising a polyether polyol;

(b) a polyisocyanate component, said polyisocyanate component providing isocyanate groups in a stoichiometric excess of the amount required to react with the hydroxyl groups of said polyol component wherein the stoichiometric ratio of the isocyanate groups in said polyisocyanate component to the hydroxyl groups in said polyol component is greater than 2:1 and no greater than about 10:1; and (c) a catalyst component comprising a catalyst that promotes the trimerization of isocyanates to form isocyanurates, said catalyst being present in an amount effective to cause trimerization of a portion of said polyisocyanate component to form isocyanurates.

2. The no-bake foundry mix described in claim 1, wherein the stoichiometric ratio of the isocyanate groups in said polyisocyanate component to the hydroxyl groups in said polyol component is from about 3:1 to about 6:1.

3. The no-bake foundry mix described in claim 1, wherein said polyol component has a functionality of at least 2 and has a viscosity of less than 1000 cps at 25° C.

4. The no-bake foundry mix described in claim 1, wherein said polyol component comprises a mixture of at least one diol and at least one polyol having a functionality of from about 3 to about 7.

5. The no-bake foundry mix described in claim 1, wherein said polyol component comprises a reactive solvent.

6. The no-bake foundry mix described in claim 1, wherein said catalyst is selected from the group consisting of potassium acetate, potassium 2-ethylhexanoate and diazobicyloundecene octoate.

7. The no-bake foundry mix described in claim 1, wherein said catalyst comprises potassium acetate.

8. The no-bake foundry mix described in claim 1, wherein said catalyst component comprises a supplemental catalyst that promotes the reaction between isocyanate groups and hydroxyl groups.

9. The no-bake foundry mix described in claim 8, to wherein said supplemental catalyst is selected from the group consisting of tertiary amines, compounds of tin, compounds of mercury, compounds of lead and compounds of bismuth.

10. The no-bake foundry mix described in claim 8, herein said supplemental catalyst comprises a tertiary amine.

11. The no-bake foundry mix described in claim 1, wherein said isocyanate component comprises polymethylene polyphenyl isocyanate.

12. A no-bake process for the fabrication of foundry shapes comprising:

A. introducing a foundry mix Into a pattern wherein said foundry mix comprises:

(1) a foundry aggregate; and (2) binder comprising:

(a) a polyol component comprising a polyether polyol:

(b) a polyisocyanate component, said polyisocyanate component providing isocyanate groups in a stoichiometric excess of the amount required to react with the hydroxyl groups of said polyol component wherein the stoichiometric ratio of the isocyanate groups in said polyisocyanate component to the hydroxyl groups in said polyol component is greater than 2:1 and no greater than about 10:1; and (c) a catalyst component comprising a catalyst that promotes the trimerization of isocyanates to form isocyanurates, said catalyst being present in an amount effective to cause trimerization of a portion of said polyisocyanate component to form isocyanurates;

B. allowing said binder components to react to form isocyanurates and to cure said foundry mix in the pattern until said foundry mix becomes self-supporting; and C. thereafter removing the shaped foundry mix of step B from the pattern and allowing it to further cure, thereby obtaining a hard. solid, cured foundry shape.

13. The no-bake process described in claim 12, wherein the stoichiometric ratio of the isocyanate groups in said polyisocyanate component to the hydroxyl groups in said polyol component is from about 3:1 to about 6:1.

14. The no-bake process described in claim 12, wherein said polyol component has a functionality of at least 2 and has a viscosity of less than 1000 cps at 25° C.

15. The no-bake process described in claim 12, wherein said polyol component comprises a mixture of at least one diol and at least one polyol having a functionality of from about 3 to about 7.

16. The no-bake process described in claim 12, wherein said polyol component comprises a reactive solvent.

17. The no-bake process described in claim 12, wherein said catalyst is selected from the group consisting of potassium acetate, potassium 2-ethylhexanoate and diazobicyloundecene octoate.

18. The no-bake process described in claim 12, wherein said catalyst comprises potassium acetate.

19. The no-bake process described in claim 12, wherein said catalyst component comprises a supplemental catalyst that promotes the reaction between isocyanate groups and hydroxyl groups.

20. The no-bake process described in claim 19, wherein said supplemental catalyst is selected from the group consisting of tertiary amines, compounds of tin, compounds of mercury, compounds of lead and compounds of bismuth.

21. The no-bake process described in claim 19, wherein said supplemental catalyst comprises a tertiary amine.

22. The no-bake process described in claim 12, wherein said isocyanate component comprises polymethylene polyphenyl isocyanate.

* * * * *